US007617681B2

(12) United States Patent
Ohman

(10) Patent No.: US 7,617,681 B2
(45) Date of Patent: Nov. 17, 2009

(54) METHOD AND MEANS FOR CONTROLLING A FLOW THROUGH AN EXPANDER

(75) Inventor: Henrik Ohman, Taby (SE)

(73) Assignee: Svenska Rotor Maskiner AB, Stockholm (SE)

( * ) Notice: Subject to any disclaimer, the term of this patent is extended or adjusted under 35 U.S.C. 154(b) by 377 days.

(21) Appl. No.: 10/589,540

(22) PCT Filed: Feb. 3, 2005

(86) PCT No.: PCT/SE2005/000130

§ 371 (c)(1),
(2), (4) Date: Aug. 16, 2006

(87) PCT Pub. No.: WO2005/078241

PCT Pub. Date: Aug. 25, 2005

(65) Prior Publication Data

US 2007/0163262 A1 Jul. 19, 2007

(30) Foreign Application Priority Data

Feb. 17, 2004 (SE) ..... 0400350

(51) Int. Cl.
*F01K 7/22* (2006.01)

(52) U.S. Cl. ..... 60/663; 415/31; 415/44

(58) Field of Classification Search ..... 60/663; 415/31, 44
See application file for complete search history.

(56) References Cited

U.S. PATENT DOCUMENTS

| | | | | |
|---|---|---|---|---|
| 3,097,490 | A * | 7/1963 | Callan et al. | 60/660 |
| 3,994,137 | A * | 11/1976 | Yasumoto et al. | 60/663 |
| 4,598,551 | A * | 7/1986 | Dimitroff et al. | 60/646 |
| 4,738,111 | A | 4/1988 | Edwards | |
| 5,327,987 | A * | 7/1994 | Abdelmalek | 180/65.2 |
| 6,174,151 | B1 | 1/2001 | Yarr | |
| 6,185,956 | B1 | 2/2001 | Brasz | |

* cited by examiner

*Primary Examiner*—Hoang M Nguyen
(74) *Attorney, Agent, or Firm*—Frishauf, Holtz, Goodman & Chick, P.C.

(57) ABSTRACT

A method and apparatus for controlling the flow of a working medium through an expansion device in a closed heating system which also includes a condenser, a pump and a boiler. The expansion device is a helical screw rotor expander that has an inlet port with an inlet line connected thereto, and an outlet port. The expansion device drives an energy producing device, such as a generator. The helical screw rotor expander has an intermediate pressure port between the inlet port and the outlet port, and a branch line is connected between the intermediate pressure port and a branching point in the inlet line. A valve is in the branch line. The flow of working medium through the valve to the intermediate pressure port is controlled as a function of a state parameter.

9 Claims, 2 Drawing Sheets

METHOD AND MEANS FOR CONTROLLING A FLOW THROUGH AN EXPANDER

This application is a U.S. National Phase Application under 35 USC 371 of International Application PCT/SE2005/000130 filed Feb. 3, 2005.

FIELD OF THE INVENTION

The present invention relates to a method of controlling a flow of working medium through an expansion device that comprises part of a closed heating system, wherein, in addition to the expansion device, the system also includes, in series, a condenser, a pump and a boiler together with an arrangement that comprises the expansion device and means for controlling the rate of flow of the medium through said device.

BACKGROUND OF THE INVENTION

Heating systems of this nature are, at present, often used to generate electrical energy from waste heat. It is desirable that a generally constant heating pressure or heating temperature is maintained in the boiler. Because the access to waste heat often varies, it is convenient to control the rate of flow of the medium through the expansion device so as to establish desired boiler conditions.

The rate of flow of the medium through the expansion device can be controlled effectively by controlling the number of revolutions. However, the control arrangement for carrying out this control involves high investment costs, which cannot be readily justified economically.

Alternatively, this control can be achieved by throttling the input flow with the aid of a throttle valve or choke. However, such throttling of the flow lowers the efficiency of the system very significantly.

SUMMARY OF THE INVENTION

An object of the present invention is to provide a method that will enable this to be achieved in the absence of revolution control means while achieving at least generally the same efficiency as that achieved when using such control means.

Another object of the invention is to provide an arrangement in which the expansion device consists of a helical screw rotor expander with which the flow of working medium through the expansion device can be controlled effectively in the absence of revolution control.

The first object is achieved by a method of controlling the flow of working medium through an expansion device that comprises part of a closed heating system, wherein, in addition to the expansion device, the system also includes, in series, a condenser, a pump and a boiler, wherein the expansion device consists in a helical screw rotor expander that has an inlet port and an outlet port connected respectively to the boiler and to the condenser. The invention is characterized by providing the helical screw rotor expander with an intermediate pressure port between the inlet port and the outlet port, by connecting the intermediate pressure port with the inlet line in a branching point, by including a valve in the branch line, and by controlling the flow of working medium through the valve to the intermediate pressure port as a function of state parameters.

The state parameter may be the pressure of the working medium or its temperature at given locations of the heating system. The state parameter is preferably measured downstream of the boiler and upstream of the branch line leading to the intermediate pressure port.

The state parameter may also be the energy delivered by the expander or the energy inputted to the heating system.

The second object is achieved with an arrangement for controlling the flow of working medium through an expansion device for use in a heating system which, in addition to the expansion device, also includes, in series, a condenser, a pump and a boiler, wherein the expansion device comprises a helical screw rotor expander that has an inlet port an inlet line connected to the inlet port, and an outlet port. The inventive arrangement is characterized by an intermediate pressure port disposed in the helical screw rotor expander between the inlet port and the outlet port, a line which connects the intermediate pressure port with the inlet line of a branch, and a valve included in the branch line, wherein the valve may be a throttle valve or choke.

The invention will now be described in more detail with reference to preferred embodiments thereof and also with reference to the accompanying drawings.

DETAILED DESCRIPTION

Figure 1:
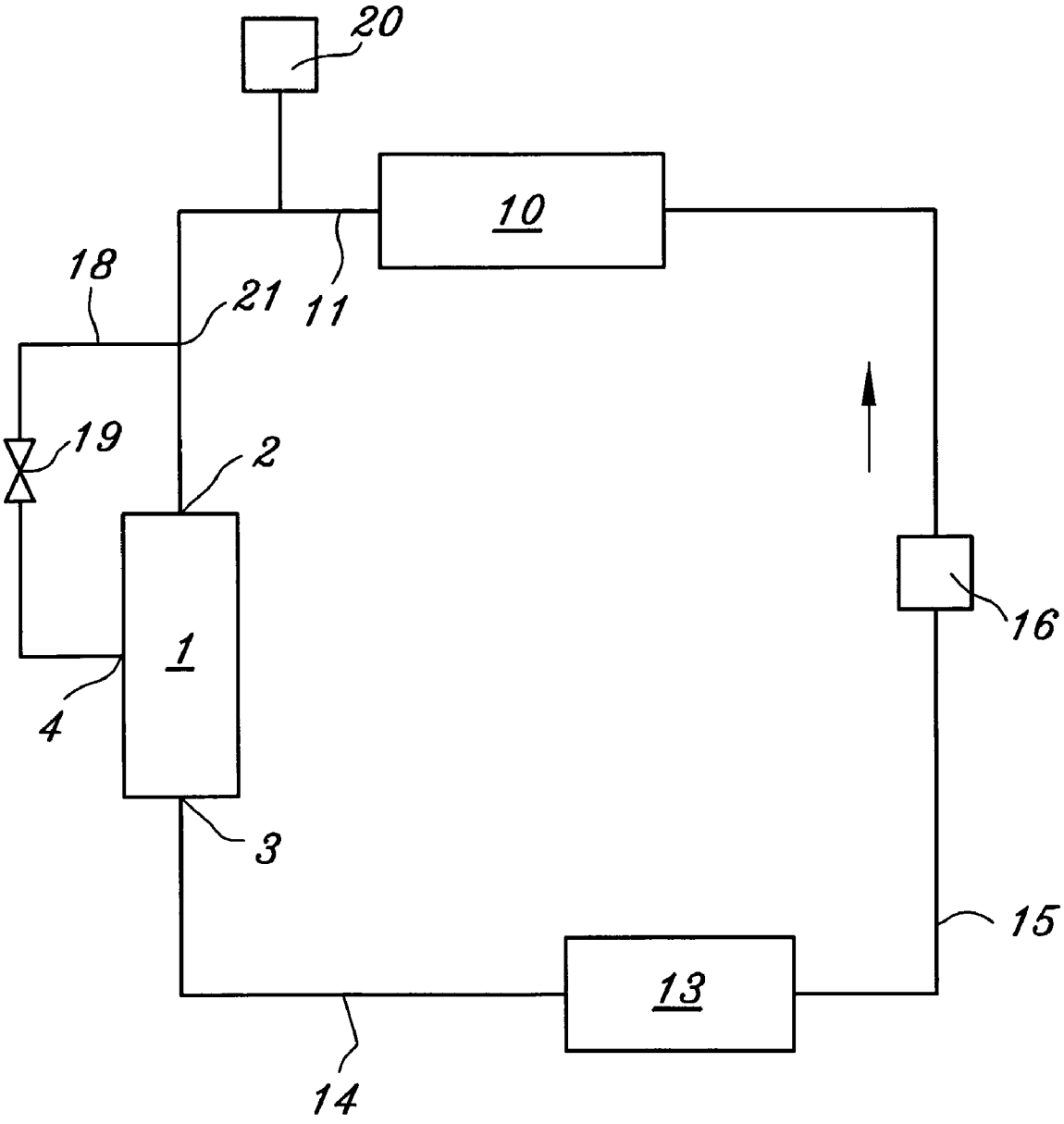
FIG. 1 is a diagrammatic view of a closed heating system that includes the inventive expansion arrangement.

The heating system shown in FIG. 1 includes a boiler 10 which functions to heat a heating medium and which is connected to the inlet port 2 of an expander 1 by means of a line 11, wherein the expander consists in a helical rotator expander in accordance with the present invention. The expander 1 has an outlet port 3, which is connected to a condenser 13 by means of a line 14. In turn, the condenser 13 is connected to the boiler 10 by means of a line 15 that includes a pump 16 for circulating the heating medium in the system.

The shaft of the helical screw rotor expander has connected thereto a generator which is driven by the force resulting from the expansion of the heating medium.

The inventive heating system also includes a branch line 18 at a branching point 21. The branch is disposed at a point on the line 11 between the boiler 10 and the expander inlet port 2. The branch line 18 opens out into an intermediate pressure port 4 of the expander 1. The expander 1 will be described in more detail below, with reference to FIG. 2. The line 18 includes a throttling element in the form of a valve 19, which is controlled as a function of a system state parameter. This state parameter can be obtained by means of a device provided in the system, such as a pressure sensor 20 for instance. According to the illustrated embodiment the pressure sensor 20 is located between the boiler 10 and the branching point 21.

Figure 2:
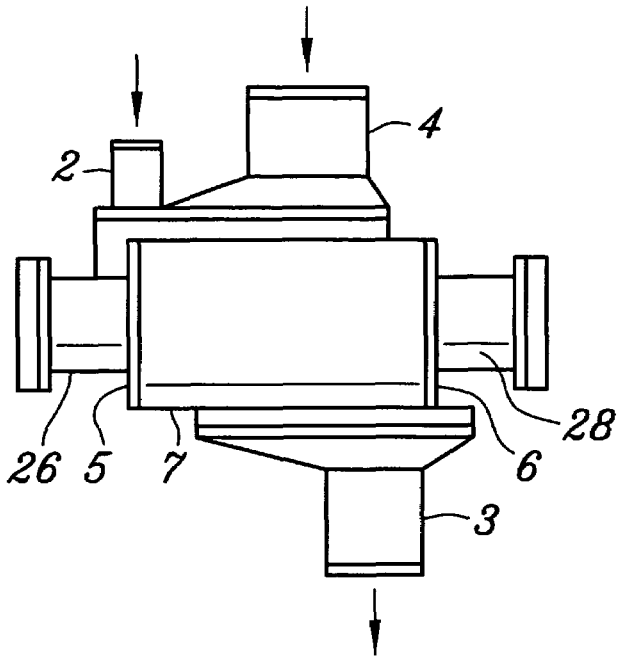
FIG. 2 is a diagrammatic side view of the helical expander.

FIG. 2 is a side view of the helical screw rotor expander. The expander housing comprises two end walls 5, 6 and a barrel wall 7 extending therebetween, these walls together defining a working chamber that accommodates two mutually co-acting rotors. The rotors are mounted respectively at 26 and 28 in a bearing housing located externally of respective end walls 5, 6. The expander 1 includes an inlet port 2, an intermediate pressure port 4 and an outlet port 3.

Figure 3:
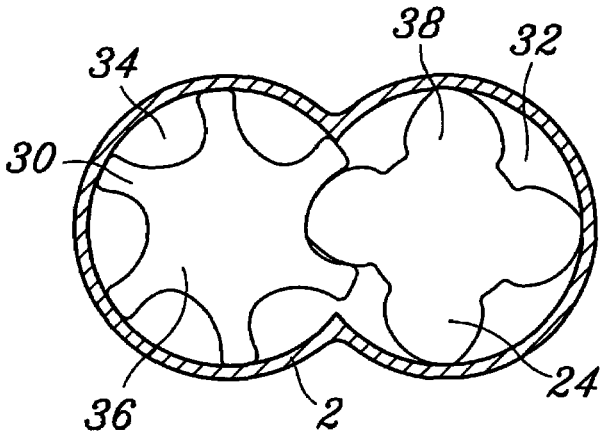
FIG. 3 is a cross-sectional view of the expander shown in FIG. 2.

As will be seen from FIG. 3, the housing-defined working chamber has the form of two mutually intersecting cylinders and accommodates a male rotor 24 and a female rotor 36 The male rotor has four helically extending lobes 38 and intermediate grooves 32 and the female rotor has 36 has six lobes 30 and intermediate grooves 34. The rotors grip one another through the agency of the lobes 38, 30 and the grooves 34, 32, wherewith working chambers are formed between the rotors and the housing walls 5, 6 and 7. The working chambers move axially along the expander as the rotors rotate, therewith changing their volumes. Each working chamber has initially a zero volume at one end of the expander and increases successively to a maximum. These volume changes are utilized in expanding a working medium with the aid of ports through which working medium of different pressures is supplied and exited at relevant positions in an expansion cycle.

Figure 4:
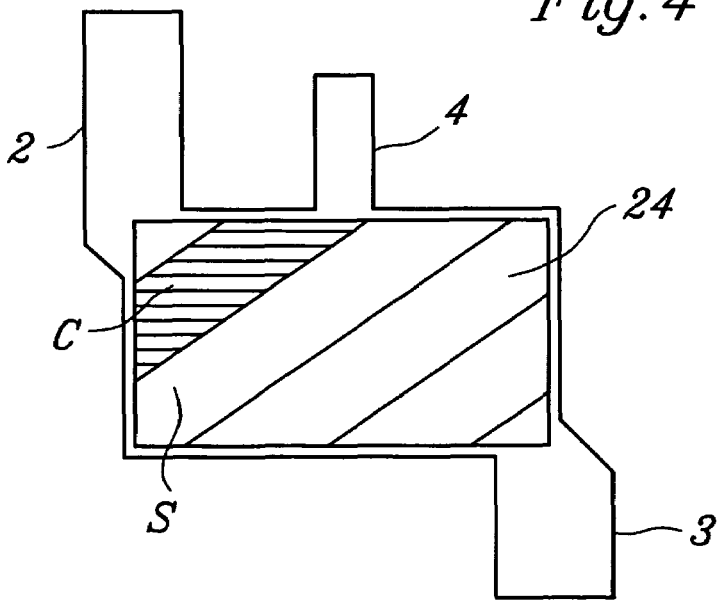
FIG. 4 is a sectioned view taken longitudinally through the expander of FIG. 3.

FIG. 4 is a diagrammatic illustration that shows how the ports are localized axially. The male rotor 24 is shown in side view, diagrammatically. The apices of respective lobes define sealing lines S with the barrel wall 7 and a chamber C is formed between two sealing lines. The chamber C connects with a similar chamber formed by the lobes of the female rotor, wherein the chambers together form a V-shaped working chamber. A study of that part of the working chamber illustrated in the figure will suffice in obtaining an understanding of the working process. In operation, each working chamber C goes through five phases during a complete working cycle, these being a first filling phase, a first expansion phase, a second filling phase, a second expansion phase and an emptying phase.

Working medium is delivered to the upper left end of the expander (as seen in the figure) from the line 11 at a pressure p greater than atmospheric pressure and passes through the inlet port 2 to a working chamber whose volume increases from zero to a relatively small volume $v_1$ when communication with the inlet port 2 is broken by the following sealing line of the working chamber. This constitutes the first filling phase.

When the working chamber then moves further to the right in the figure its volume will again increase, therewith resulting in a reduction in pressure in the working chamber. This expansion phase continues until the preceding sealing line reaches the intermediate pressure port 4. At this moment in time, the volume of the working chamber has increased to $v_2$, which is high enough to create in the working chamber a pressure that is lower than p.

When the preceding sealing line reaches the intermediate pressure port 4, the working chamber begins to communicate with the line 19, in which the pressure is higher than the chamber pressure. While the working chamber communicates with the intermediate pressure port 4 its pressure will rise to p, in other words to the same pressure as that prevailing in the line 18, due to the inflow of medium from the line 18. This second filling phase ends when the chamber has moved so far to the right (in the figure) that communication with the intermediate pressure port 4 is broken by the following sealing line.

The expansion continues until the preceding sealing line reaches the outlet port 3. The outlet port 3 is located so that the pressure in the working chamber will have fallen to the level of atmospheric pressure when the chamber comes in connection with this port.

The working medium then passes to the condenser 13 and from there to the boiler 10, via the line 15 and the pump 16.

Referring back to FIG. 1, at "normal" pressure P or a pressure lower than P in the line 11 (indicated by the pressure sensor 20) the valve 19 is closed so as to allow the working medium to pass only in a direction towards the inlet port 2. When the pressure in the line 11 rises to above P, the setting of the valve 19 is changed so that a sub-flow passes the valve 19 in the line 18 and continues to the intermediate pressure port 4 and into the working chamber of the expander 1 connected to this port.

The pressure sensor 20 may be located somewhere else in the heating system, for instance downstream of the expander 1 or downstream of the condenser 13.

The temperature can be measured at different locations in the system as an alternative to measuring pressure. The pressure sensor 20 will then be replaced by a thermometer, which can also be caused to measure the temperature downstream of the boiler 10 or downstream of the expander 1 or downstream of the condenser 13.

The energy delivered by the expander 1 or the energy delivered to the heating system from the boiler 10 are examples of other state parameters that can be measured in the present context.

The invention claimed is:

1. A method of controlling a closed heating system for generating energy from heat by controlling a flow of a working medium through an expansion device included in the closed heating system which, in addition to the expansion device, also includes a condenser, a pump and a boiler, wherein the expansion device comprises a helical screw rotor expander that has an inlet port, and an outlet port connected to an inlet of the condenser, wherein the helical screw rotor expander comprises two helical co-acting rotors surrounded by a housing, said rotors together forming a plurality of V-shaped working chambers which, due to rotation of the rotors, travel in a direction from the inlet port towards the outlet port and continuously increase in volume at least during a part of said traveling, wherein the condenser comprises an outlet connected to an inlet of the pump, the pump comprises an outlet connected to an inlet of the boiler, and the boiler comprises an outlet connected to the inlet port of the helical screw rotor expander through an inlet line, and wherein the expansion device drives an energy producing device, the method comprising:

providing the helical screw rotor expander with an intermediate pressure port between the inlet port and the outlet port, wherein the intermediate pressure port communicates with the helical screw rotor expander where a given V-shaped working chamber is increasing in volume and is closed from communication with both the inlet port and the outlet port, and wherein the intermediate pressure port is connected with the inlet line via a branch line between the intermediate pressure port and a branching point in the inlet line, wherein a valve is included in the branch line, and the flow of the working medium through the valve to the intermediate pressure port is controlled as a function of a state parameter.

2. The method according to claim 1, further comprising using a pressure of the working medium as the state parameter.

3. The method according to claim 1, further comprising using a temperature of the working medium as the state parameter.

4. The method according to claim 1, further comprising using energy delivered by the expander as the state parameter.

5. The method according to claim 1, further comprising using energy delivered to the heating system as the state parameter.

6. A closed heating system for generating energy from heat including an arrangement for controlling a flow of a working medium through an expansion device included in the closed heating system, wherein the closed heating system further includes a condenser, a pump, a boiler, and requisite connection lines, wherein the expansion device includes a helical screw rotor expander that has an inlet port, and an outlet port connected to an inlet of the condenser, wherein the helical screw rotor expander comprises two helical co-acting rotors surrounded by a housing, said rotors together forming a plurality of V-shaped working chambers which, due to rotation of the rotors, travel in a direction from the inlet port towards the outlet port and continuously increase in volume at least during a part of said traveling, wherein the condenser comprises an outlet connected to an inlet of the pump, the pump comprises an outlet connected to an inlet of the boiler, and the boiler comprises an outlet connected to the inlet port of the helical screw rotor expander through an inlet line, and wherein the expansion device drives an energy producing device, and wherein:

the helical screw rotor expander includes an intermediate pressure port between the inlet port and the outlet port, wherein the intermediate pressure port communicates with the helical screw rotor expander where a given V-shaped working chamber is increasing in volume and is closed from communication with both the inlet port and the outlet port, and wherein a branch line connects the intermediate pressure port with the inlet line at a branching point, and a valve is provided in the branch line.

7. The system according to claim 6, wherein the valve comprises a control valve.

8. The system according to claim 6, wherein the energy producing device comprises a generator.

9. The method according to claim 1, wherein the energy producing device comprises a generator.

* * * * *